US005777791A

United States Patent [19]

Hedblom

[11] Patent Number: 5,777,791

[45] Date of Patent: Jul. 7, 1998

[54] WET RETROREFLECTIVE PAVEMENT MARKING ARTICLES

[75] Inventor: Thomas P. Hedblom, Eagan, Minn.

[73] Assignee: Minnesota Mining and Manufacturing Company, St. Paul, Minn.

[21] Appl. No.: 756,866

[22] Filed: Nov. 26, 1996

[51] Int. Cl.[6] ..... G02B 5/128

[52] U.S. Cl. ..... 359/536; 359/539; 359/540; 404/12; 404/14

[58] Field of Search ..... 359/534–542, 359/547, 551, 552; 404/12, 14, 16; 428/325

[56] References Cited

U.S. PATENT DOCUMENTS

| | | | |
|---|---|---|---|
| 3,043,196 | 7/1962 | Palmquist et al. . | |
| 3,935,365 | 1/1976 | Eigenmann | 428/323 |
| 4,146,635 | 3/1979 | Eigenmann | 428/283 |
| 4,299,874 | 11/1981 | Jones et al. | 428/143 |
| 4,490,432 | 12/1984 | Jordan | 428/220 |
| 4,564,556 | 1/1986 | Lange | 428/325 |
| 4,772,511 | 9/1988 | Wood et al. | 428/325 |
| 4,969,713 | 11/1990 | Wyckoff . | |
| 4,988,541 | 1/1991 | Hedblom | 427/163 |
| 4,988,555 | 1/1991 | Hedblom | 428/172 |
| 5,207,852 | 5/1993 | Lightle et al. | 156/230 |
| 5,268,682 | 12/1993 | Yang et al. | 345/200 |
| 5,316,838 | 5/1994 | Crandall et al. | 428/283 |
| 5,417,515 | 5/1995 | Hachey et al. | 404/15 |

FOREIGN PATENT DOCUMENTS

| | | |
|---|---|---|
| 0 232 980 A | 8/1987 | European Pat. Off. . |
| 0 237 315 A | 9/1987 | European Pat. Off. . |
| 0 385 746 A | 9/1990 | European Pat. Off. . |
| 0 683 269 A | 11/1995 | European Pat. Off. . |
| 0 683 270 A | 11/1995 | European Pat. Off. . |
| 0 683 403 A | 11/1995 | European Pat. Off. . |
| 665 665 A5 | 5/1988 | Switzerland . |
| WO 95/08426 A | 3/1995 | WIPO . |
| WO 96/06982 A | 3/1996 | WIPO . |

OTHER PUBLICATIONS

U.S. Ser. application No. 08/503,532, filed Jul. 18, 1995.

ASTMD ASTND 4061–94, "Standard Test Method for Retroreflectance of Horizontal Coatings", Apr. 1994, pp. 461–467.

*Primary Examiner*—James Phan

*Attorney, Agent, or Firm*—Robert H. Jordan

[57] ABSTRACT

Retroreflective articles, for example in the form of pavement markers or retroreflective elements, exhibit both wet and dry retroreflectivity by using a plurality of Type A microspheres and a plurality of Type B microspheres partially embedded in a binder layer containing specular pigments. The Type A and Type B microspheres have different average indices of refraction.

12 Claims, 2 Drawing Sheets

WET RETROREFLECTIVE PAVEMENT MARKING ARTICLES

FIELD OF INVENTION

The present invention relates to a retroreflective pavement marking material that exhibits good retroreflective brightness under both wet and dry conditions.

BACKGROUND

Pavement markings, such as those on the centerline and edgeline of a roadway, are important in order to provide visual guidance for motor vehicle drivers. Pavement marking materials are used as traffic control markings for a variety of uses, such as short distance lane striping, stop bars, pedestrian pavement markings at intersections, and long line lane markings on roadways. A common form of pavement marking materials is adhesive-backed tape that is applied to the roadway surface in desired location and length. The top surface of the tape has selected color and typically retroreflective characteristics.

Currently, many flat pavement markings typically rely on an exposed-lens retroreflective optical system comprising transparent microspheres partially embedded in a binder layer containing reflective pigment particles such as titanium dioxide ($TiO_2$) or lead chromate ($PbCrO_4$). In use, light from the headlamp of a vehicle enters the microsphere and is refracted to fall on the reflective pigment. Some portion of the light is returned generally in the direction of the vehicle so as to be visible to the driver. It is known in the art that retroreflective performance diminishes substantially when exposed microspheres become wet unless the microspheres have a refractive index greater than about 2.5.

Under dry conditions, principles of optics predict the optimum refractive index for a microsphere coated with a hemispherical specular reflector to be about 1.9 to 1.93. However when that same microsphere is covered with water, the optimum refractive index is predicted to be about 2.6 to 2.65. Thus, by using a mixture of about 1.9 refractive index and about 2.6 to 2.65 refractive index microspheres with specular reflectors coated hemispherically thereon, both dry and wet retroreflection can be achieved. Such uses have been made in the art.

U.S. Pat. No. 3,043,196 (Palmquist et al.) teaches the use of approximately 1.9 refractive index microspheres for retroreflection under dry conditions and approximately 2.5 index microspheres for retroreflection under wet conditions to produce a retroreflective aggregate. In use, these aggregates are dropped on to a binder layer freshly applied to the roadway. As the binder dries, the aggregates become secure thereby forming a pavement marker. It is also disclosed that microspheres of refractive index varying from about 1.7 to 2.9 can be used. It is not disclosed that microspheres of lower refractive index, for example lower than 2.5, could be useful or advantageous for wet retroreflectivity.

U.S. Pat. No. 5,207,852 (Lightle et al.) teaches a method for making retroreflective fabric using a mixture of microspheres having about 1.9 refractive index and about 2.5 refractive index for retroreflection under both dry and wet conditions. It is disclosed that microspheres having a refractive index of about 2.5 will provide retroreflection when covered with water, whereas microspheres having a refractive index of about 1.9 will be less effective when wet. The sheeting construction is said to have an air permeable web of thermoplastic filament making it suitable for use as a retroreflective fabric. However, such a construction would not be suitable for use as a pavement marker which is exposed to repeated traffic impacts. The microspheres used have substantially hemispherical reflective layers, preferably aluminum or silver, coated thereon. Because true or brilliant color is a desirable feature in pavement markings, an aluminum vapor coat, with its inherent gray appearance, would be less desirable. A silver reflective layer creates a whiter appearance. However, it is well known in the art that silver tend to suffer more severe and more rapid degradation in outdoor exposure. Also, there is no teaching of uses of microspheres of less than 2.5 refractive index for wet retroreflectivity.

U.S. Pat. No. 5,417,515 (Hachey et al.) discloses a pavement marking using a mixture of microspheres with refractive index of 1.93, and microspheres with a higher refractive index, for example 2.65, for optical efficiency under both dry and wet conditions. However, only the use of 2.65 refractive index microspheres is disclosed for wet retroreflection. Such a use is known in the art and is predicted by principles of optics. There is no specific teaching of lower refractive index microspheres, i.e., lower than 2.65, as being useful for wet retroreflectivity. It is also disclosed that the use of the mixture of microspheres with separate specular and diffuse reflecting layers provided for retroreflectivity over a wide range of entrance angles.

U.S. Pat. No. 5,316,838 (Crandall et al.) teaches the use of 1.9 refractive index microspheres with the use of 2.3 refractive index microspheres to provide dry and wet retroreflection for a retroreflective sheet with an elastic backing. The sheets can be used to make sweat bands, clothing, footwear, i.e., in applications that require a high degree of elastic properties. Such applications would not be suitable for pavement markings which must withstand repeated exposure to traffic impact. The microspheres have a reflective means such as metal coatings, metal flakes, or dielectric coatings on their rear surfaces. Disclosed examples of metal coatings and metal flakes are aluminum or silver. Although these metals provide high retroreflective brightness, they tend to result in a somewhat gray appearance. Because true colors are a desired feature in pavement markings, such metal coatings would be less effective.

The need exists for pavement marking materials that provide improved retroreflective brightness under dry and wet conditions.

SUMMARY OF INVENTION

The present invention provides retroreflective articles that are capable of efficient retroreflection under both wet and dry conditions. The inventive articles use two types of microspheres as optical elements, Type A and Type B. The Type A and Type B microspheres have different average indices of refraction, with the Type A microspheres having an average refractive index of about 1.9 to about 2.0 and the Type B microspheres having an average refractive index of about 2.2 to about 2.3. The microspheres are partially embedded in and protrude from a binder layer that comprises specular pigment particles.

In one embodiment, the inventive article is a retroreflective pavement marker comprising: (a) a typically resilient polymeric base sheet having a front surface; (b) a plurality of protrusions projecting from the front surface of the base sheet, each of the protrusions having a top surface and at least one side surface connecting the top surface to the front surface of the base sheet; (c) a binder layer comprising particles of specular reflector pigment, the binder layer covering selected portions of the protrusions; and (d) partially embedded in the binder layer, a plurality of Type A microspheres and a plurality of Type B microspheres. Typically at least about 10 percent by weight of the microspheres are Type A and at least about 10 percent by weight of the microspheres are Type B.

In another embodiment, the inventive article is a retroreflective element comprising: (a) a core element; and (b) partially embedded in the core, a plurality of Type A microspheres and a plurality of Type B microspheres. Typically at least 10 percent by weight of the total microspheres are Type A and at least 10 percent by weight of the microspheres are Type B.

In accordance with this invention, the retroreflective pavement marker is useful for efficient retroreflection under both wet and dry conditions without the use of very high index microspheres. As used herein, "very high index" microspheres denote those that have greater than about 2.5 refractive index. Although very high refractive index microspheres are commercially available, they remain very expensive to fabricate. Because the very high index microspheres are surprisingly not needed to realize the advantages of this invention, manufacturing cost of the inventive article is reduced. Articles of the present invention may be used in horizontal applications, such as a marking on a road, or in vertical applications, such as markings on a Jersey barrier.

BRIEF DESCRIPTION OF THE DRAWINGS

The invention will be further explained with reference to the drawings, wherein.

These figures, which are idealized, are not to scale and are intended to be merely illustrative and non-limiting.

DETAILED DESCRIPTION OF PREFERRED EMBODIMENTS

Articles of the present invention provide effective retroreflection under both dry and wet conditions. The articles rely on an exposed-lens optical system comprising a plurality of Type A microspheres and a plurality of Type B microspheres; Type A microspheres having an average refractive index of about 1.9 to about 2.0 and Type B microspheres having an average refractive index of about 2.2 to about 2.3.

In one embodiment, the inventive article is a pavement marking having a base sheet that is typically resilient polymer, and having protrusions projecting from the front surface of the base sheet, a binder layer containing specular pigment particles, and Type A and Type B microspheres partially embedded in the binder layer. The binder layer can be a separate layer on the specified portion or portions of the base sheet or may be the strata or portion of the protrusions in which the microspheres are embedded. Typically, antiskid particles are deposited on the top surface of the marking to increase the skid resistance of the marking. Optionally, an adhesive layer is provided on the bottom of the base sheet and/or a scrim layer included in the marking, if desired. The scrim may, for instance, be a woven or nonwoven material.

In another embodiment, the inventive article is a retroreflective element comprising Type A and Type B microspheres partially embedded in the surface of a core, e.g., of a thermoplastic resin, that contains specular pigments. The retroreflective elements can have substantially spherical, disc and cylindrical shapes, although other shapes can be produced if desired.

Patterned pavement markings have advantageous vertical surfaces, e.g., defined by protrusions, in which microspheres are partially embedded. Because the light source usually strikes a pavement marker at high entrance angles, the vertical surfaces, containing embedded microspheres, provide for more effective retroreflection. Vertical surfaces also keep the microspheres out of the water during rainy periods thereby improving retroreflective performance.

Figure 1:
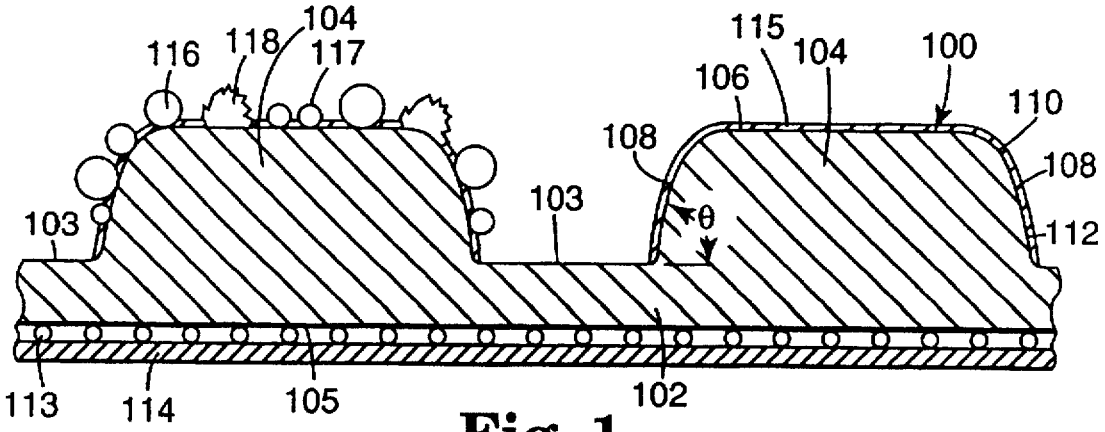
FIG. 1 is a cross-sectional view of an illustrative pavement marking of the invention.

FIG. 1 shows patterned pavement marker 100 containing a resilient polymeric base sheet 102 and a plurality of protrusions 104. For illustrative purposes, only one protrusion 104 has been covered with microspheres and antiskid particles. Base sheet 102 has front surface 103 from which the protrusions extend, and back surface 105. Base sheet 102 is typically about 1 mm (0.04 inch) thick, but may be of other dimension if desired. Optionally, maker 100 may further comprise scrim 113 and/or adhesive layer 114 on back surface 105.

Protrusion 104 has top surface 106, side surfaces 108, and in an illustrative embodiment is about 2 mm (0.08 inch) high. Protrusions with other dimensions may be used if desired. As shown, side surfaces 108 meet top surface 106 at a rounded top portions 110. Side surfaces 108 preferably form an angle θ of approximately 70° to 72° at the intersection of front surface 103 with lower portion 112 of side surfaces 108.

Protrusion 104 is coated with pigment-containing binder layer 115. Embedded in binder layer 115 are a plurality of Type A microspheres 116 and a plurality of Type B microspheres 117. Optionally, antiskid particles 118 may be embedded on binder layer 115.

Figure 2:
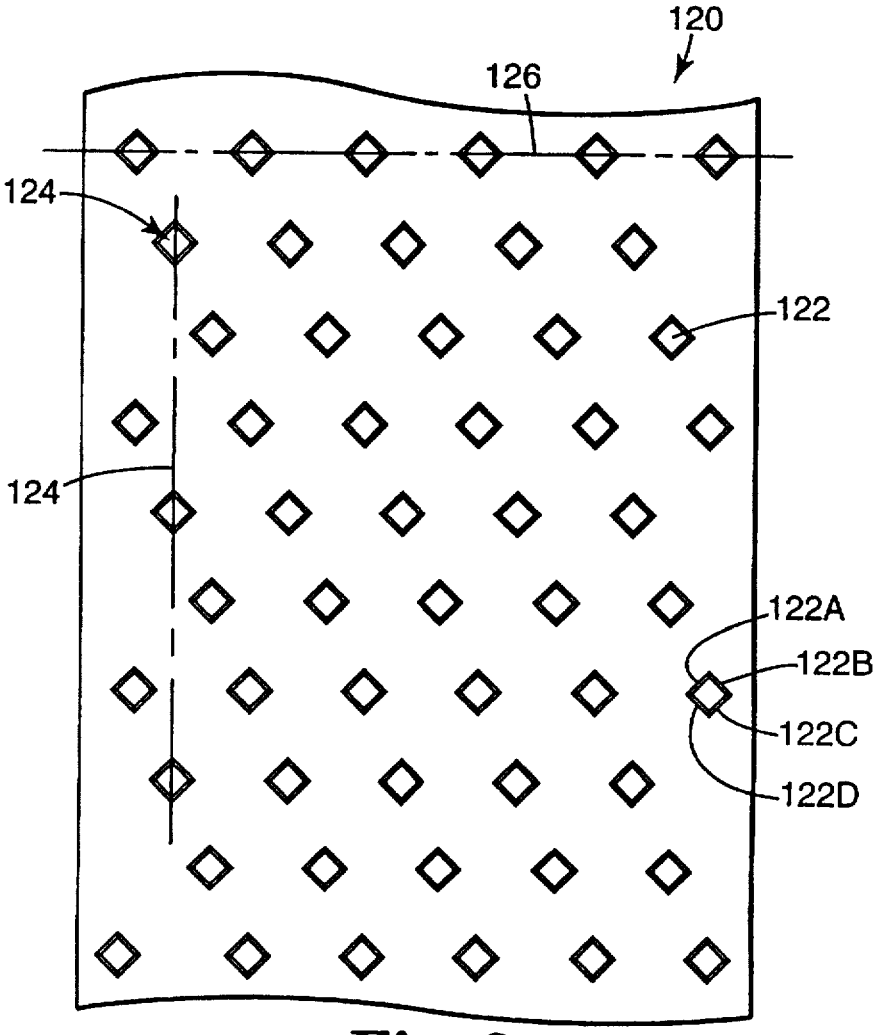
FIG. 2 is a plan view of a portion of an illustrative pavement marking of the invention and, FIG. 3 is a plan view of an illustrative retroreflective element in accordance with the invention.

In FIG. 2 there is shown a portion of pavement marker 120 with protrusions 122 having sides 122A, 122B, 122C, and 122D, all having the same length, e.g., about 6.4 mm (0.25 inch). In illustrative embodiments, protrusions 122 within column 124 are spaced about 59 mm (2.3 inch) apart and protrusions 122 within row 126 are spaced about 26 mm apart (1 inch).

Several embodiments of patterned pavement markings with a variety of different shapes, size, and arrangement of protrusions are well known in the art and may be used in accordance with the present invention.

An illustrative process of making a patterned pavement marker involves four main steps. First, a resilient polymeric base sheet with protrusions is provided. Second, a liquid, specular pigment-containing binder solution is selectively applied to desired surfaces of the protrusions, leaving the other portions of the base sheet substantially free of the binder solution. Third, Type A and Type B microspheres and other useful particles, such as antiskid particles, are embedded in the binder solution. Fourth, the binder solution is solidified, holding the microspheres and particles in place. U.S. Pat. No. 4,988,541 (Hedblom) discloses a preferred method of making patterned pavement markings and is incorporated herein by reference in its entirety. Optionally, a scrim (e.g., woven or nonwoven) and/or an adhesive layer can be attached to the back side of the polymeric base sheet, if desired.

The optical elements used in the present invention are light transmissive microspheres. They act as spherical lenses with incident light being refracted through them and into the binder layer containing specular pigment particles. The pigment particles reflect a portion of the incident light such that it is directed back towards the light source.

The optical elements of the present invention comprise a plurality of Type A microspheres having a refractive index of about 1.9 to about 2.0 and a plurality of Type B microspheres having a refractive index of about 2.2 to about 2.3. Type A microspheres are intended for primarily for dry retroreflectivity, although in combination with the pigment particles they will retroreflect under wet conditions with less efficiency. Type B microspheres are intended primarily for wet reflectivity, although in combination with the pigment particles they will retroreflect under dry conditions with less efficiency. Thus, the blend of Type A and Type B microspheres provide effective dry and wet retroreflectivity.

The microspheres can be glass or non-vitreous ceramic. The non-vitreous ceramic microspheres are typically preferred for greater durability and abrasion resistance. Preferred non-vitreous ceramic microspheres are disclosed in U.S. Pat. No. 4,564,556 (Lange) and 4,772,511 (Wood et al.). Glass microspheres provide a desirable balance of somewhat less durability at lesser cost. Preferably, the larger microspheres are non-vitreous ceramic and the smaller microspheres are glass. In such case, enhanced abrasion resistance of the pavement marker is achieved.

In many preferred embodiments of the invention, one of the two types of microspheres will be larger than the other. For instance, it is easier to make commercial quantities of Type A microspheres (e.g., non-vitreous ceramics) that are very hard and abrasion resistant than to make similarly hard Type B microspheres. Thus, typically, Type A microspheres are about 175 to 250 microns in diameter while Type B microspheres are about 50 to 100 microns in diameter. In such case, the smaller Type B microspheres will fit interstitially among the larger Type A microspheres. As a result, the Type B microspheres are protected against abrasion caused by repeated traffic wear. If desired, Type B microspheres can be chosen to be larger than Type A microspheres. Typically the larger microspheres will cover more than about 50 percent of the retroreflective portion of the pavement marking surface area.

In such two size embodiments, Type A microspheres are preferably present in at least 25 weight percent of the total amount of microspheres used, and Type B microspheres are preferably present in at least 15 weight percent. More preferably, Type A microspheres are present from about 65 to about 85 weight percent, and Type B microspheres are present from about 15 to about 35 weight percent. These ranges are preferred because they provide a good balance between dry and wet retroreflectivity and provide good abrasion resistance.

The microspheres are preferably placed selectively on the side and top surfaces of the protrusions while leaving the valleys between protrusions substantially clear so as to minimize the amount of microspheres used, thereby minimizing the manufacturing cost. The microspheres may be placed on any of the side surfaces as well as the top surface of the protrusions to achieve efficient retroreflection.

In pavement marking applications, it is important that motorists distinguish between different colored markers, for example, between white and yellow markers. If desired, light transmissive colorants can be added to the microspheres to enhance both daytime and nighttime color. For example, a yellow dye could be added to the microspheres which could be used to make a yellow pavement marker. See U.S. Pat. No. 5,268,682 (Jacobs et al.).

The binder layer comprises a light transmissive coating medium so that light entering the retroreflective article is not absorbed but is instead retroreflected. Other important properties for this medium include durability for intended use, ability to keep the pigment particles suspended, coating ability, and adequate wetting and microsphere adhesion. Typically, it comprises a resilient polymeric material. For ease of coating, the medium will preferably be a liquid with a viscosity of less than 10,000 centipoise at coating temperatures. Vinyls, acrylics, epoxies, and urethanes are examples of suitable mediums, although other materials with similar characteristics may be used. Urethanes, such as are disclosed in U.S. Pat. No. 4,988,555 (Hedblom) are preferred binder mediums. The binder layer covers selected portions of the protrusions so that the base sheet remains substantially free of the binder.

Specular pigment particles are generally thin and plate-like and are part of the binder layer. Light striking the pigment particles is reflected at an angle equal but opposite to the angle at which it entered. Suitable examples of specular pigments for use in the present invention include pearlescent pigments, mica, and nacreous pigments. All of these specular pigments exhibit leafing characteristics where they tend to align themselves parallel to the web or parallel to the surface on which they have been coated. When a microsphere is dropped onto and becomes indented in the coating medium containing the specular pigment, the coating material underneath the bottom of the microsphere has the most compression and tends to pull the pigment flakes down with it. The effect is that the pigment particles tend to line up like a coating around the embedded portion of the microsphere. This tendency of the pigment particles to line up and effectively coat the microspheres improves their specular reflecting efficiency.

Typically, the amount of specular pigment present in the binder layer is less than 50 percent by weight. Preferably, the specular pigments comprise about 15 percent to 40 percent of the binder layer by weight, this range being the optimum amount of specular pigment needed for efficient retroreflection.

Pearlescent pigment particles are preferred for use in the present invention because of the true colors in their appearance. Trueness in color is a desired feature in pavement marking constructions because of the demand for color contrast between the road and the marking.

As shown in FIG. 1, backing layers comprising scrim 113 and adhesive layer 114 are attached to back surface 105 of base sheet 102. These backing layers allow the pavement marker to be attached to a surface, such as a roadway, and as known in the art, can impart desired properties, e.g., tensile or greater tear strength, conformability, removeability, etc.

Illustrative examples of suitable materials for the scrim include a woven fibrous material or a nonwoven material. A suitable woven scrim can be made out of polyester, although other materials may be used. The scrim is laminated to back surface 105 such that it is partially embedded therein. The scrim provides added tensile strength to the pavement marker, allowing for easier removal from the roadway, if necessary. The added tensile strength imparted by the scrim also minimizes the stretching and improves tear resistance a pavement marker may experience during application. The scrim aids in the processing of the pavement marker by allowing for easier roll formation, easier converting of the pavement marker, and easier handling. Uses of scrim, whether woven or nonwoven, to reinforce a base sheet or for other purposes are known in the art. See, e.g., U.S. Pat. Nos. 3,935,365 (Eigenmann); 4,146,635 (Eigenmann); 4,299,874 (Jones); and 4,969,713 (Wyckoff).

An adhesive may be laminated to the back side of the marking. Those skilled in the art will recognize that care must be taken in selecting an adhesive that will adhere adequately to the roadway surface and overlying marking under desired conditions. One suitable adhesive is a synthetic rubber based pressure sensitive adhesive. A suitable adhesive for a specific application can be readily selected by those skilled in the art.

Figure 3:
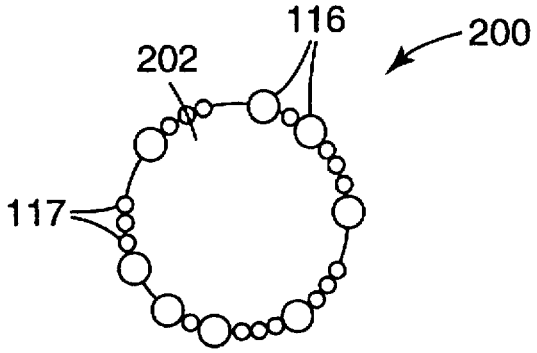

Another embodiment of the invention is a retroreflective element comprising Type A and Type B microspheres partially embedded in the surface of a core containing, at least in the strata in which the partially protruding microspheres are embedded, specular pigments. As shown in FIG. 3, retroreflective element 200 has core 202 comprising specular pigments (not shown). Partially embedded in the core are a plurality of Type A microspheres 116 and a plurality of Type B microspheres 117. Illustrative examples of suitable materials for the core include a thermoplastic resin or threads of fibrous materials, such as cotton or polyester yarn, coated with a binder solution.

Like a pavement marker, a retroreflective element provides for a vertical surface where microspheres are partially embedded. Ease of manufacturing is an advantage of a retroreflective element. The manufacturing process comprises: (a) providing for a bed of Type A and Type B microspheres and core elements comprising a thermoplastic material, and (b) agitating the combination of microspheres and core elements for a sufficient period of time and at a sufficient temperature to coat the microspheres onto the surface of the core elements to form retroreflective elements. Assignee's U.S. patent application Ser. No. 08/503532, filed Jul. 18, 1995, discloses preferred retroreflective elements and method for making them and is incorporated herein by reference in its entirety.

EXAMPLES

The following examples illustrate different embodiments of the invention. However, the particular ingredients and amounts used as well as other conditions and details are not to be construed in a manner that would unduly limit the scope of this invention. All amounts expressed in parts or percentages are by weight, unless otherwise stated.

Wet Retroreflectivity Test

The wet retroreflectivity of pavement markings was measured using a LTL 2000 meter (available from Delta Light & Optics, Lyngly, Denmark) which measures retroreflective brightness at a 88.8° entrance angle and a 1.05° observation angle. Results were reported as Coefficient of Retroreflected Luminance ($R_L$) in millicandelas/meter$^2$/lux. The 88.8° entrance angle and a 1.05° observation angle configuration is similar to that which would be experienced by a driver of an average automobile 30 meters away from the reflective pavement marking. The 4 inch by 6 inch (10.2 cm×15.2 cm) pavement marking sample was first laid horizontally in the test area and then flooded with a solution of tap water and 0.1 weight percent AJAX Brand dishwashing soap. The solution was allowed to run off, and brightness measurements taken after 1 minute and after 2 minutes. Soap is added to the water to increase surface wettability of the sheeting. The soap also better simulates the effect of rain after the reflective pavement marking has been on the road for some time, when it has been subjected to increased wettability due to the actions of sun, abrasive grit and sand, and dirt accumulations.

Abrasion Resistance

Abrasion resistance of microspheres was determined using a vehicle wear simulator. This simulator is designed to simulate shear, wear, and abrasion conditions experienced by a pavement marker located near a roadway intersection.

The simulator has a test area consisting of a vertical annular ring about 11 feet (3.3 meters) in diameter and about 1 foot (0.3 meter) in width having an unprimed concrete surface.

Two passenger car tires, with an inflation pressure of about 35 pounds/inch$^2$ ($2.45\times10^5$ Pascals), are positioned horizontally against opposite ends of the annular ring. A load is applied pneumatically to the connecting frame exerting a pressure of about 40 pounds/inch$^2$ ($2.8\times10^5$ Pascals) on the tires. The frame is rotated, driving the tires across the surface of the test area at about 40 revolutions/minute which corresponds to a lineal speed of about 16.3 miles/hour (26 kilometers/hr) simulating the high impact shear and abrasion forces encountered at a roadway intersection.

To achieve even higher shear and abrasion between the tires and the retroreflective elements, the tires were fitted with 80 grit sandpaper. Sixteen strips of 2 inch×6 inch (5 cm×15 cm) sandpaper are mounted in equally spaced intervals on the tire treads. As the tire makes contact with the retroreflective elements, the sandpaper also makes contact with the retroreflective elements.

EXAMPLE 1

Binder solutions with varying pearlescent pigment concentration were made to examine the effects of microspheres' refractive index in the presence of pearlescent pigment on retroreflectivity response. For ease of experimentation, the binder solutions were coated on to a flat release liner to make binder layers.

Binder solution 1 at about 9% pearlescent pigment loading contained the following components: (1) 50 parts of clear urethane resin (having 50% solids) 3M SCOTCHLITE Brand 4430R from Minnesota Mining and Manufacturing (3M) Company, St. Paul, Minn., (2) 5 parts of crosslinking solution 3M SCOTCHLITE Brand 4430 B from 3M Company, St. Paul, Minn., and (3) 2.4 parts of BRIGHT SILVER Brand pearlescent pigment from Mearl Corp., from Brarcliff Manor, N.Y. Binder solution 2 at about 17% pearlescent pigment loading was made as in binder solution 1 except 5.1 parts of BRIGHT SILVER Brand pearlescent pigment was used. Binder solution 3 at about 26% pearlescent pigment loading was made as in binder solution 1 except 9 parts of BRIGHT SILVER Brand pearlescent pigment was used. Binder solution 4 at about 35% pearlescent pigment loading was made as in binder solution 1 except 13.5 parts of BRIGHT SILVER Brand pearlescent pigment was used.

A first layer of binder solution was coated onto a flat release liner at a wet thickness of 0.005 inch (0.0127 cm) and dried at 250° F. (121° C.) for five minutes. Each of the four binder solutions with different pearlescent pigment loading was coated separately. A second layer of the same binder solution as the first layer was coated onto the first dried binder layer at a wet thickness of 0.010 inch (0.0254 cm). This second layer was allowed to air dry up to 12 minutes. During this air drying interval, a plurality of microspheres were flood coated onto the wet binder solution. Different air drying times were used in order to obtain embedment of the microspheres to about 50% of their diameter.

Four sets of microspheres were used. Each set had a different refractive index. Thus, set 1 microspheres had a refractive index of about 1.93; set 2 at about 2.26; set 3 at about 2.4; and set 4 at about 2.64. Each binder layer sample had one level of pearlescent pigment loading and microspheres at one refractive index.

The coefficient of retroreflection in (candelas/lux)/meter$^2$ were measured for each sample according to ASTM D 4061-94. The retroreflectivity measurements were made at one entrance angle/observation angle geometry of 0.2°/–4° respectively. The samples were first measured dry. Wet retroreflectivity was done by dipping the samples in ethyl alcohol, taking them out of the ethyl alcohol, and then measuring them. Ethyl alcohol was used because it has nearly the same index of refraction as water. Ethyl alcohol wetted out the samples completely. Tables I, II, III, and IV showed the retroreflectivity results for various samples.

TABLE I

| Retroreflectivity At Pearlescent Pigment Loading of About 9% | | |
|---|---|---|
| Microsphere Index of | Coefficient of Retroreflection (ASTM D 4061-94) 0.2°/–4° Entrance/ Observation Angle | |
| Refraction | Dry | Wet |
| 1.93 | 13.80 | 0.88 |
| 2.26 | 0.45 | 2.38 |
| 2.40 | 0.30 | 3.25 |
| 2.64 | 0.25 | 4.75 |

TABLE II

| Retroreflectivity At Pearlescent Pigment Loading of About 17% | | |
|---|---|---|
| Microsphere Index of | Coefficient of Retroreflection (ASTM D 4061-94) 0.2°/–4° Entrance/ Observation Angle | |
| Refraction | Dry | Wet |
| 1.93 | 23.80 | 0.75 |
| 2.26 | 0.58 | 6.75 |
| 2.40 | 0.35 | 1.75 |
| 2.64 | 0.25 | 5.00 |

TABLE III

| Retroreflectivity At Pearlescent Pigment Loading of About 26% | | |
|---|---|---|
| Microsphere Index of | Coefficient of Retroreflection (ASTM D 4061-94) 0.2°/–4° Entrance/ Observation Angle | |
| Refraction | Dry | Wet |
| 1.93 | 30.00 | 0.55 |
| 2.26 | 0.75 | 8.25 |
| 2.40 | 0.40 | 2.50 |
| 2.64 | 0.28 | 4.50 |

TABLE IV

| Retroreflectivity At Pearlescent Pigment Loading of About 35% | | |
|---|---|---|
| Microsphere Index of | Coefficient of Retroreflection (ASTM D 4061-94) 0.2°/–4° Entrance/ Observation Angle | |
| Refraction | Dry | Wet |
| 1.93 | 32.50 | 0.60 |
| 2.26 | 0.73 | 11.50 |
| 2.40 | 0.50 | 7.00 |
| 2.64 | 0.28 | 6.00 |

The data in the tables above show that at pearlescent pigment loading of about 17% and above, wet retroreflectivity of microspheres having about 2.26 refractive index outperformed the higher refractive index microspheres of 2.4 or 2.64. Furthermore, the data show that for dry retroreflectivity, the 1.93 refractive index microspheres had the best performance at any pearlescent pigment loading. Thus, a combination of 1.93 refractive index microspheres with 2.26 refractive index microspheres would provide effective retroreflection under both dry and wet conditions.

EXAMPLE 2

A patterned pavement marking was made using a plurality Type A non-vitreous ceramic microspheres and a plurality of Type B glass microspheres in the following manner.

A patterned polymeric base sheet had protrusions with dimensions of 0.1 inch high (0.254 cm), 0.25 inch long (0.64 cm) in the transverse direction, and 0.19 inch wide (0.48 cm) in the longitudinal direction. In the longitudinal direction, the rows were separated by about 0.4 inch (1.02 cm). Each successive row was staggered so as to minimize shadowing effects of the protuberances from one row to the next. Binder solution 4 of Example 1 having about 35% pearlescent pigment loading was coated onto a release liner at a wet thickness of 0.040 inch (0.10 cm). The patterned polymeric base sheet was laminated to the wet binder solution such that only the protrusions were coated with the binder solution. No binder solution was coated in the valleys between the protrusions. The release liner containing binder solution 4 was then peeled off the patterned base sheet.

About 4 grams of Type A non-vitreous ceramic microspheres with diameters of about 0.008 inch (200 micron) and refractive index of about 1.93 were scattered onto 24 square inches (155 cm$^2$) of the patterned polymeric base sheet with coated binder solution. A copious amount of Type B glass microspheres with diameters of about 0.003 inch (70 micron) and refractive index of about 2.26 were flood coated onto the same sample and became embedded in the interstices between the Type A index non-vitreous ceramic microspheres. The sample was then cured at 250° F. (212° C.) for 5 minutes to yield a patterned pavement marking. Dry retroreflectivity was measured using the LTL-2000 meter. Wet retroreflectivity was measured according to the Wet Retroreflectivity Test. The results are summarized in Table V.

Comparative Example A

A patterned pavement marking was made according to Example 2 except only Type A non-vitreous ceramic microspheres were used. Dry retroreflectivity was measured using the LTL-2000 meter. Wet retroreflectivity was measured according to the Wet Retroreflectivity Test. The results are summarized in Table V.

Comparative Example B

For comparison purposed, a 3M STAMARK Brand High Performance Tape Series 380, available from 3M, St. Paul, Minn., was used. This particular tape comprised 1.75 refractive index ceramic microspheres partially embedded in a urethane binder layer containing titanium dioxide diffuse reflector pigment. U.S. Pat. No. 4,988,555 (Hedblom) discloses patterned pavement marking construction of this example.

TABLE V

| Pavement Marking Sample | Coefficient of Retroreflected Luminance (LTL-2000) Dry | Wet (after 1 min.) | Wet (after 2 min.) |
|---|---|---|---|
| Example 2 | 1430 | 620 | 640 |
| Comparative A | 1970 | 340 | 360 |
| Comparative B | 1070 | 250 | 280 |

As Table V shows, patterned pavement markings of the present invention that used a plurality Type A and Type B microspheres, as in Example 2, outperformed a sample that used only Type A microspheres, as in Comparative Example A, under wet retroreflectivity. Example 2 is about twice as bright as Comparative Example A when wet. Also, with time the Comparative Example A sample did not recover quickly its brightness after being wetted. Example 2 of the present invention also outperformed Comparative Example B under both dry and wet conditions.

EXAMPLE 3

Binder layers containing various blends of Type A non-vitreous ceramic and Type B glass microspheres were made to examine the effects of the microsphere blends on abrasion resistance. The samples were made as follows.

A urethane binder solution, described as a bead bond solution in U.S. Pat. No. 4,988,541 (Hedblom) in column 4 starting at line 39, was coated at a wet thickness of 0.004 inch (0.01 cm) on to the top surface of a 0.055 inch (0.14 cm) flat rubber film.

Five microsphere blends were sprinkled on to five different samples of binder coated rubber films. The samples were 6 inch long by 4 inch wide (15 cm by 10 cm). The blends included varying weight percentages of Type A microspheres of about 0.008 inch (200 micron) diameter and Type B microspheres of about 0.003 inch (70 micron) diameter as described in Table VI. After the microspheres were sprinkled on to the wet binder solution, the samples were cured at 175° F. (79° C.) for about 30 minutes to secure the microspheres in the binder layer. A pressure sensitive adhesive of 0.003 inch to 0.005 inch thick (0.008 cm to 0.013 cm) was laminated to the bottom side of the rubber film.

TABLE VI

| Sample No. | Type A | Type B |
|---|---|---|
| 1 | 100 | 0 |
| 2 | 83 | 17 |
| 3 | 66 | 34 |

TABLE VI-continued

| Sample No. | Type A | Type B |
|---|---|---|
| 4 | 50 | 50 |
| 5 | 0 | 100 |

The cured samples were applied to a vehicle wear simulator for abrasion resistance testing. The samples were exposed to 1,500 revolutions for a total of 3,000 contacts with the two tires. After the samples were exposed to the simulator, they were removed and visually observed under a microscope for damage.

TABLE VII

Damage to Microspheres Resulting from Vehicle Wear Simulator

| Sample No. | Damage to Type A (% surface area damaged) | Damage to Type B (% surface area damages) |
|---|---|---|
| 1 | minimal | — |
| 2 | light | light |
| 3 | light | 20% |
| 4 | light | 25–30% |
| 5 | light | 80% |

Sample 1 had no Type B microspheres and thus no data was reported. Table VII shows that some acceptable loss in abrasion is seen between samples 2 and 3, i.e. where the Type A microspheres were present from about 66% to 83% and where Type B microspheres were present about 17% to 34%.

EXAMPLE 4

A patterned pavement marking with a woven scrim laminated to the back side (i.e. flat side) of the base sheet was made as follows.

A polymeric base sheet as disclosed in U.S. Pat. No. 4,490,432 (Jordan), in a softened state, was fed into a nip created by a metal embossing roll containing a pattern and a steel roll. The softened polymeric base sheet is embossed to create a patterned base sheet. Simultaneously, a woven scrim made from 100% polyester multi-filament threads was placed on the steel roll and nipped to the back side (i.e. the flat side) of the base sheet material. The polyester woven scrim was supplied by Alpedira Textil, SRL from Pavia, Italy. The woven scrim has a basis weight of 0.78 lb/yd$^2$ (200 grams/meter$^2$) with about 0.125 inch (0.32 cm) squares, and was about 0.0075 inch (0.02 cm) thick. The woven scrim was nipped into the softened polymeric base sheet at about 250° to 260° F. (121° to 127° C.) and at a force of about 1900 lb/lineal inch (about 3300 N/cm). The resulting base sheet has a woven scrim embedded in the back side. The pattern of protrusions on the polymeric base sheet is described in Example 2. Subsequent processing steps to apply the binder solution and Type A and Type B microspheres were done as in Example 2 to yield a pavement marker of the invention.

Various modifications and alterations of this invention will be apparent to those skilled in the art without departing form the scope and spirit of this invention.

What is claimed is:

1. A retroreflective pavement marker comprising:

a) a base sheet having a front surface and a back surface;

b) a plurality of protrusions projecting from said front surface of said base sheet, each of said protrusions having a top surface and at least one side surface connecting said top surface to said front surface of said base sheet;

c) a binder layer comprising particles of specular reflector pigment, said binder layer covering a portion of said protrusions; and d) partially embedded in said binder layer, a plurality of Type A microspheres and a plurality of Type B microspheres, wherein at least 10 percent by weight of the total microspheres are Type A and at least 10 percent by weight of the total microspheres are Type B, said Type A microspheres have a different average refractive index than do said Type B microspheres, and said Type B microspheres have an average refractive index of about 2.2 to about 2.3.

2. The marker of claim 1 wherein said Type A microspheres have an average diameter of about 175 to 250 microns.

3. The marker of claim 1 wherein said Type B microspheres have an average diameter of about 50 to 100 microns.

4. The marker of claim 1 wherein said Type A microspheres and said Type B microspheres are selected from at least one of the group consisting of glass and non-vitreous ceramic.

5. The marker of claim 1 wherein said binder layer is discontinuous.

6. The marker of claim 1 wherein said Type A microspheres have an average index of refraction of about 1.9 to about 2.0.

7. The marker of claim 1 wherein said binder layer comprises about 15 to about 40 percent by weight particles of specular reflector pigment.

8. The marker of claim 1 wherein said specular reflector pigment is selected from at least one of the group consisting of pearlescent pigment, mica, and nacreous pigment.

9. The marker of claim 1 further comprising antiskid particles deposited on selected areas of said protrusions.

10. The marker of claim 1 further comprising at least one of the group consisting of an adhesive layer on the back side thereof and a scrim layer.

11. A retroreflective pavement marker comprising:

a) a base sheet having a front surface and a back surface;

b) a plurality of protrusions projecting from said front surface of said base sheet, each of said protrusions having a top surface and at least one side surface connecting said top surface to said front surface of said base sheet;

c) a binder layer comprising particles of specular reflector pigment, said binder layer covering a portion of said protrusions; and d) partially embedded in said binder layer, a plurality of Type A microspheres and a plurality of Type B microspheres, said Type A microspheres are non-vitreous ceramic and said Type B microspheres are glass, and about 65 to about 85 percent by weight of the total microspheres are Type A microspheres.

12. The retroreflective pavement marker of claim 11 wherein about 15 to about 35 percent by weight of the total microspheres are Type B microspheres.

* * * * *